US011898445B1

(12) United States Patent
Joyce

(10) Patent No.: US 11,898,445 B1
(45) Date of Patent: Feb. 13, 2024

(54) PORTABLE CORING MACHINE

(71) Applicant: Patrick Joyce, Chicago, IL (US)

(72) Inventor: Patrick Joyce, Chicago, IL (US)

( * ) Notice: Subject to any disclaimer, the term of this patent is extended or adjusted under 35 U.S.C. 154(b) by 0 days.

(21) Appl. No.: 18/076,598

(22) Filed: Dec. 7, 2022

(51) Int. Cl.
*E21B 7/02* (2006.01)
*E21B 19/083* (2006.01)
*E21B 3/02* (2006.01)

(52) U.S. Cl.
CPC ..... *E21B 7/027* (2013.01); *E21B 3/02* (2013.01); *E21B 19/083* (2013.01)

(58) Field of Classification Search
CPC ..... E21B 7/027; E21B 19/083; E21B 19/08; E21B 25/00
See application file for complete search history.

(56) References Cited

U.S. PATENT DOCUMENTS 1,440,788 A * 1/1923 Morgan ..... E21C 27/06 299/63
1,674,189 A * 6/1928 Brown ..... E21B 7/021 175/242
1,824,946 A * 9/1931 Cartlidge ..... E21C 25/00 299/48
2,754,087 A * 7/1956 Johnson ..... E21B 7/025 173/27
3,294,185 A * 12/1966 O'Neill ..... E21B 19/20 166/356
3,490,550 A * 1/1970 Horton ..... E02F 3/90 175/246
3,570,606 A * 3/1971 Guritz ..... B25H 1/0021 173/186
4,161,988 A * 7/1979 Hart ..... E21B 7/028 173/152
6,315,059 B1 * 11/2001 Geldean ..... E21B 7/028 173/147
2005/0126821 A1 * 6/2005 Davies ..... E21B 7/028 175/244
2013/0062126 A1 * 3/2013 Thorne ..... E21B 7/027 175/162

FOREIGN PATENT DOCUMENTS

| | | |
|---|---|---|
| CN | 209992215 | 1/2020 |
| CN | 210289621 | 4/2020 |
| CN | 111119774 | 5/2020 |
| CN | 211179057 | 8/2020 |
| CN | 111619019 | 9/2020 |
| KR | 101676415 | 11/2016 |

* cited by examiner

*Primary Examiner* — Shane Bomar
(74) *Attorney, Agent, or Firm* — Lathrop GPM LLP; Richard Beem; Alex Shtraym

(57) ABSTRACT

The present invention relates generally to a portable coring machine for penetrating a surface to install or repair subsurface structures. Coring machine may include a frame assembly and a drilling device. Frame assembly may include a plurality of interconnected bars and facilitate operating drilling device in a generally horizontal position or in a generally vertical position. Further, frame assembly may accommodate core bits of different sizes for cutting an annular hole into asphalt, concrete or other hard surface. Support members of frame assembly may be configured to support a track including a plurality of teeth. The track may engage with a gear assembly of a mounting block configured to support the drilling device. Advantageously, coring machine may be moveable along track in response to an operator rotating a crank mechanically coupled to the gear assembly.

18 Claims, 3 Drawing Sheets

PORTABLE CORING MACHINE

FIELD OF INVENTION

The present invention relates generally to drilling machines and, more specifically, to a coring machine for penetrating a surface to install or repair sub-surface structures.

BACKGROUND OF THE INVENTION

Coring often refers to the process of drilling circular holes in asphalt, concrete or other hard surface. Core drilling techniques are commonly used for underground utilities construction, such as manhole taps, underground vault taps, and wherever sewer, water, steam, air or communication lines pass through a concrete or brick structure.

Conventional coring machines generally include a stand or foundation, a drive unit, and a drill bit rotatably driven by the drive unit. Typically, the stand or foundation is constructed to absorb or support a counter-torque that is produced during drilling. In addition, since the forces associated with drilling large core holes are high, conventional coring machines are typically anchored or secured to a surface or structure to remain in place while a core is formed. As a result, conventional coring machines are difficult to transport and often require large amount of resources, such as time, money, and manual labor.

Further, conventional coring machines typically rely on hydraulic or gas motors to turn a coring bit. Use of a hydraulic motor may require additional resources and equipment, such as a hydraulic pump to provide high-pressure fluid for powering the motor. Moreover, operators of a conventional gas powered coring machine may be exposed to combustion fumes.

Accordingly, there is a need for an improved coring machine for penetrating a surface to install or repair sub-surface structures that may reduce the burden on an operator. The present invention satisfies this need.

SUMMARY OF THE INVENTION

The present invention relates generally to a portable coring machine for penetrating a surface to install or repair sub-surface structures. Coring machine be used in a generally horizontal position or in a generally vertical position to, for example, drill holes in a sidewall of a pipe and/or core drill an opening on a street for a manhole. Further, coring machine may be moveable along track in response to an operator rotating a crank mechanically coupled to the gear assembly.

In one aspect, coring machine may include a frame assembly formed by a plurality of interconnected bars. The plurality of bars may include horizontal bars and vertical bars. Further, the plurality of bars may include curved bars and bent bars. The plurality of bars may define a front section, a rear section, a top section, and a bottom section of frame assembly. Sections of frame assembly may form a rectangular cross section, however, other shapes are contemplated.

Coring machine may include a seat removably coupled to the frame assembly for supporting an operator. In particular, the seat may include a saddle formed of a material bent back upon itself. A bent portion of the saddle may be attached to the top section of the frame assembly via hardware.

Coring machine may further include a track configured to secure to the frame assembly. In particular, the track may be secured to the bottom section of frame assembly and extend longitudinally between the front and the rear section. The track may include a plurality of teeth or protrusions. Further, the track may be configured to support a mounting block.

The mounting block may include a gear assembly configured to engage with the teeth of the track. The mounting block may also include a shaft mechanically coupled to the gear assembly. In operation, rotation of a crank rotatably coupled to the shaft causes the mounting block to move along the track.

Further, a motor of the coring machine may be mounted on the mounting block. Motor may be an electric motor powered by a battery or including a power cord for use with an outlet or another suitable power source. In response to an operator rotating a crank mechanically coupled to the gear assembly of the mounting block, a core bit of a drilling device may be moveable toward and/or away from a surface or structure.

Coring device may further include a guide configured to support the core bit. Each end of the guide may be coupled to the frame assembly via a rod. The rod may include threaded portions for use with adjusting hardware. Adjusting hardware may facilitate raising and/or lowering the guide to accommodate for core bits of different diameters.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to limit the present invention, where like designations denote like elements, and in which.

DETAILED DESCRIPTION OF THE INVENTION

The present invention relates generally to drilling machines and, more specifically, to a coring machine for penetrating a surface to install or repair sub-surface structures. The figures illustrate different views of an exemplary claw device.

FIG. 1 through FIG. 5 illustrate an exemplary coring machine 100. As shown, coring machine 100 may include a frame assembly 102 and a drilling device 104. A weight of coring machine 100 may be between about fifty pounds and about one hundred pounds, and preferably between about seventy pounds and about ninety pounds. In one embodiment, coring machine 100 may weight about eighty pounds.

Frame assembly 102 may be made of steel or another metal sufficiently rigid and sturdy to support the weight of one or more operators without noticeable bending or deformation. It is further contemplated that frame assembly 102 may be made of a corrosion resistance material, such as stainless steel, copper, bronze, or other alloys.

Further, frame assembly 102 may range in length from about thirty-six inches to about seventy-two inches, and preferably between about forty-eight inches and about sixty inches. In one embodiment, frame assembly 102 may be approximately fifty-five inches long. In addition, a height of frame assembly 102 may be between about twelve inches and about twenty-four inches. In one embodiment, frame assembly 102 about may be approximately eighteen inches in height. Further, a width of frame assembly 102 may range from about ten inches to about twenty inches. In one embodiment, frame assembly 102 may be approximately seventeen inches wide.

Figure 1:
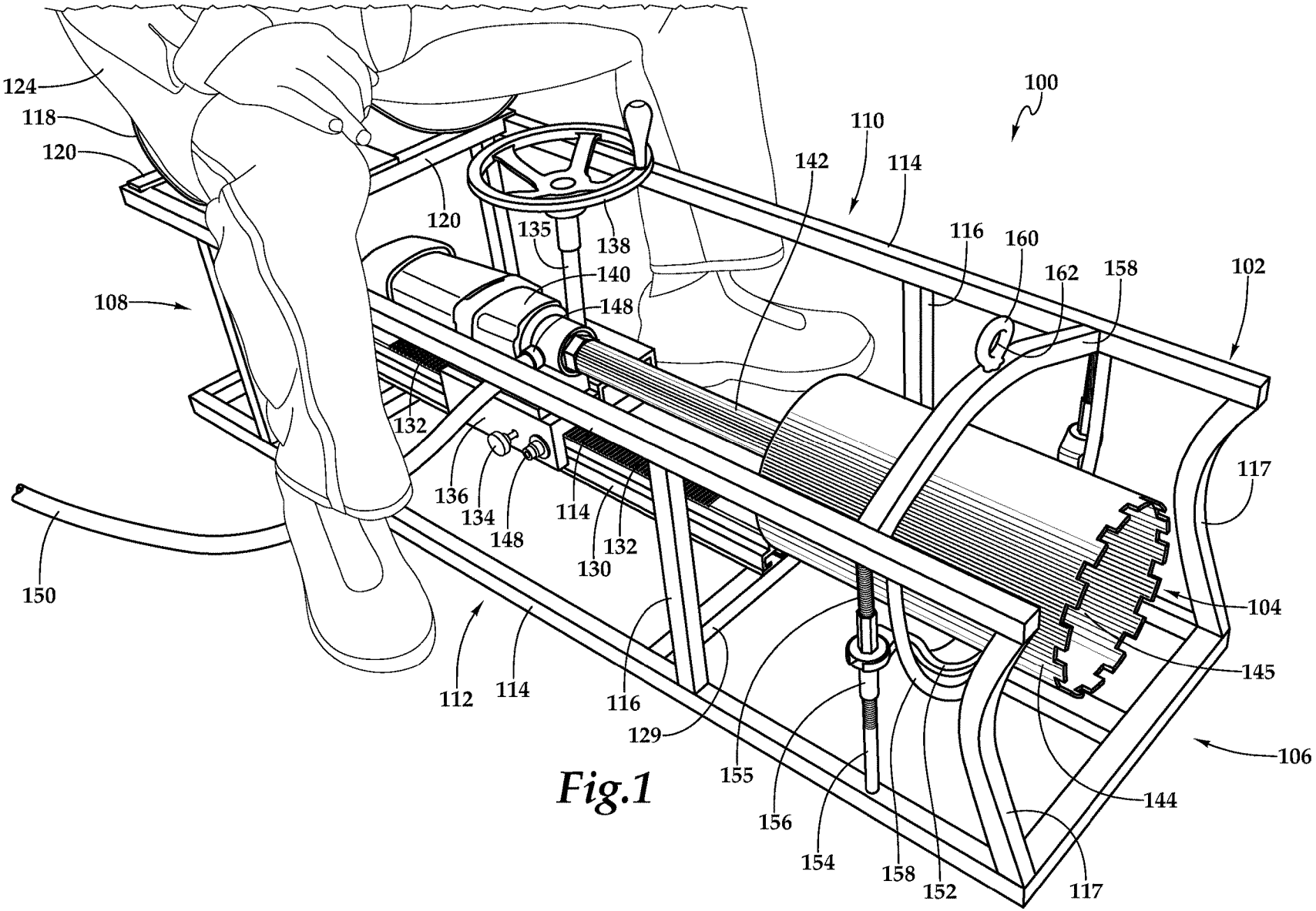
FIG. 1 is a perspective view of an exemplary coring machine.

More specifically, as shown in FIG. 1, frame assembly 102 may include a front section 106, a rear section 108, a top section 110, and a bottom section 112. In particular, frame assembly 102 may be formed by a plurality interconnected bars including horizontal bars 114 and vertical bars 116. Interconnected bars may be hollow to reduce the weight of coring machine 100.

Horizontal and vertical bars 114, 116 may be welded to one another or attached via hardware, such as a bolt or screws. Further, horizontal and vertical bars 114, 116 may be connected such that frame assembly 102 includes a substantially rectangular cross section, however, other shapes are contemplated. Horizontal and vertical bars 114, 116 may have a thickness ranging between about half an inch and about one and a half inches, and preferably between about one inch and about one and a quarter inches.

As shown, front section 106 of frame assembly 102 may include one or more bent vertical bars 117. Bent bars 117 may be disposed radially inwardly extending from bottom section 112 to top section 110. Specifically, bent bars 117 may be adapted to engaged with a curved surface or structure. For instance, bent bars 117 may be configured for positioning flush against a pipe for forming or creating additional branches of a tunneling system. At its center, bent vertical bars 117 may be bent between a range of about one inch and about four inches, and preferably between about two inches and about three inches.

Figures 2, 3:
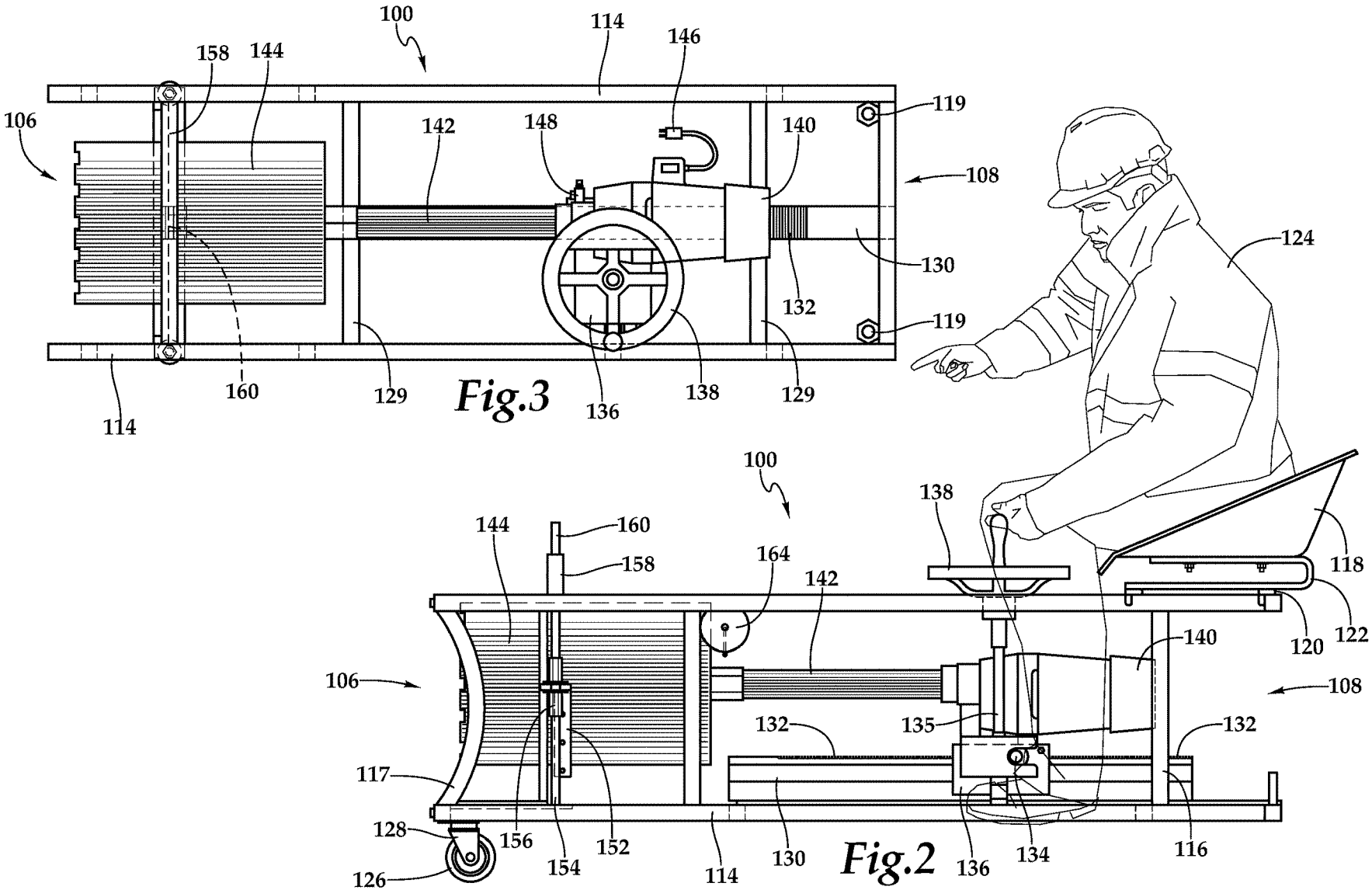
FIG. 2 is a top view of the coring machine.
FIG. 3 is a side view of the coring machine in a generally horizontal orientation.

As shown in FIG. 1 and FIG. 2, coring machine 100 may further include a seat 118. Seat 118 may be positioned proximate rear section 108 of frame assembly 102. More specifically, seat 118 may be removable coupled to one or more seat posts 120 via a saddle 122. Seat posts 120 may extend across top section 110 of frame assembly 102. A height of seat 118 from top section 110 may range between about one inch and about four inches, and preferably between about three inches and about four inches. As such, the positioning of seat 118 may allow an operator 124 to comfortably place their feet on the ground on either side of frame assembly 102. Furthermore, it is contemplated that seat 118 may be a steel tractor seat including holes for allowing water to drain through.

As shown, saddle 122 may be made formed of a material that may be configured to bend back upon itself to, for example, counterbalance a weight of operator 124 during operation. In a seated positioned, a weight of operator 124 may prevent movement of coring machine 100 during operation. Alternatively or in addition, as shown in FIG. 2, frame assembly 102 may include corner holes 119 configured to, for example, receive driving rods for securing coring machine 100 to a surface or ground level, if necessary.

Further, as shown in FIG. 2, coring machine 100 may include one or more wheels 126 removably coupled to bottom section 112 of frame assembly 102. For instance, wheels 126 may be positioned proximate front section 106 of frame assembly 102 to minimizes the number of personnel needed to transport coring machine 100 to various locations of a construction site. It is further contemplated that one or more wheels 126 may be pivotably connected to frame assembly 102 via a caster 128 to facilitate movement in multiple directions.

FIG. 3 illustrates a top view of exemplary coring machine 100. As shown, frame assembly 102 may further include one or more support members 129 extending across bottom section 112. A track including a plurality of protrusions or teeth 132 may be secured to support members 129. Track 130 may extend longitudinally a distance between the front section 106 and the rear section 108 of said frame assembly 102. In particular, track 132 may have a length ranging between about twenty inches and about forty inches, and preferably between about twenty-five inches and about thirty-five inches.

As shown in FIGS. 1-2, track 132 may engage with a gear assembly 134 of a mounting block 136 configured to support drilling device 104. More specifically, a pinion of gear assembly 134 may be mechanically coupled to a shaft 135 including a hand crank 138. Shaft 135 may extend upwardly from mounting block 136 past top section 110 of frame assembly 102 and rotatably couple with hand crank 138.

In operation, when hand wheel or crank 138 is energized or rotated by operator 124, shaft 135 will cause the pinion of gear assembly 134 to rotate resulting in movement of mounting block 136 along track 130. In other words, drilling device 104 is moveable along track 130 in response to operator 124 rotating crank 138. In the event that gear assembly 134 is immobilized, e.g., operator 124 holds the wheel or crank 138, then mounting block 136 will also be immobilized, thereby preventing any lateral movement of drilling device 104. Although crank 138 is described as manually operated, it is contemplated that movement of mounting block 136 along track 132 may be automated.

As shown in FIGS. 1-5, drilling device 104 may include a motor 140, a drive shaft 142, and a core bit 144. In one embodiment, drilling device 104 may be a DBE 201 Diamond Core Drill Rig for use in wet drilling reinforced concrete, stone, asphalt, marble, ceramic, walls, floors and the like.

Motor 140 may be detachably mounted on mounting block 136 such that drilling device 104 may move toward and away from a surface. Motor 140 may be an electric motor powered via internal power source, such as a battery. Alternatively, as shown in FIG. 3, motor 140 may be plugged into a standard electrical outlet via power cord 146. A rotational speed of motor 140 may range between about five hundred RPM and about one thousand RPM, and preferably between about six hundred RPB and about seven hundred RPM. Further, a current of motor 140 may range between about ten amps and about thirty amps, and preferably between about fifteen amps and about twenty amps. One example of motor 140 may be a eighteen amp, 110V motor.

As shown in FIG. 1, motor 140 may further include a connector 148 for receiving a hose 150. Water may be injected via hose 150 into drilling device 104 to facilitate wet coring. In particular, water injected via hose 150 may be supplied to core bit 144 to, for example, collect drilling dust and prevent overheating.

Drive shaft 142 may extend from motor 140 for transferring rotary power to core bit 144. Drive shaft 138 may couple to bit 144 via any suitable coupling or connector. Drive shaft 138 have a length ranging between about twenty inches and about thirty inches, and preferably between about twenty-four inches and about twenty-eight inches.

Core bit 144 may be supported at or near the end of drive shaft 142 and may facilitates cutting an annular hole into asphalt, concrete or other hard surface. In particular, as core bit 144 advances into a surface, the core is received in an inner cavity 145 defined by inner tubular wall, and advances upstream, relatively, as core bit 144 advances into the surface. In other words, the core extracted via drilling device 104 should have substantially the same diameter as inner cavity 145 of core bit 144. A diameter of core bit 144 may range between about four inches and about sixteen inches, and preferably between about six inches and about twelve inches.

Figure 4:
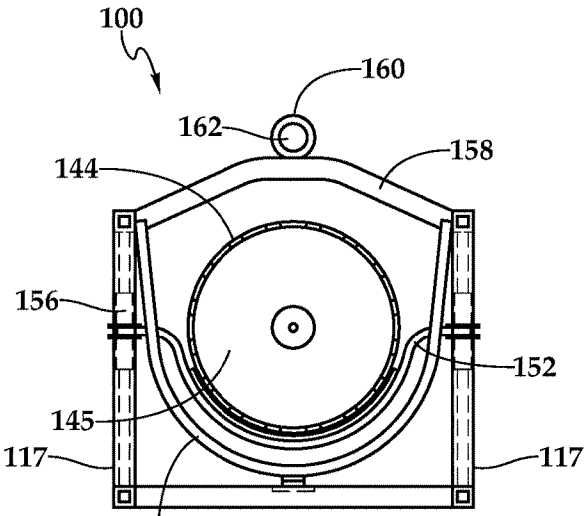
FIG. 4 is a front view of the coring machine illustrating a guide for supporting a core bit.

As shown in FIG. 4, core bit 144 may be supported by a guide 152. Guide 152 may be coupled to frame assembly 102 via one or more rods 154 extending from bottom section 112 to top section 110. In particular, rods 154 may include a threaded portion 155 and adjusting hardware 156 for raising or lowering guide 152 to accommodate coring bits of different diameters. For example, as shown, adjusting hardware 156 may include nuts and washers rotatably secured to threaded portion 155 to allow for vertical movement of guide 152.

FIG. 4 further illustrates one or more curved horizontal bars 158 proximate front section 106 of frame assembly 102. As shown, curved bars 158 may be concave and/or convex and coupled to either end of top section 110 of frame assembly 102. In particular, curved bars 158 may surround core bit 144 to, for example, support and provide structural rigidity to frame assembly 102. Furthermore, one or more curved bars 158 may include an eyelet 160 defining an opening 162. Opening 162 may extend at least one inch above curved bars 158 to, for example, couple with a hook of a crane, hoist, winch, trolley, and the like. For instance, due to the additional weight of an extracted core, lifting machinery may be required for moving coring machine 100.

Figure 5:
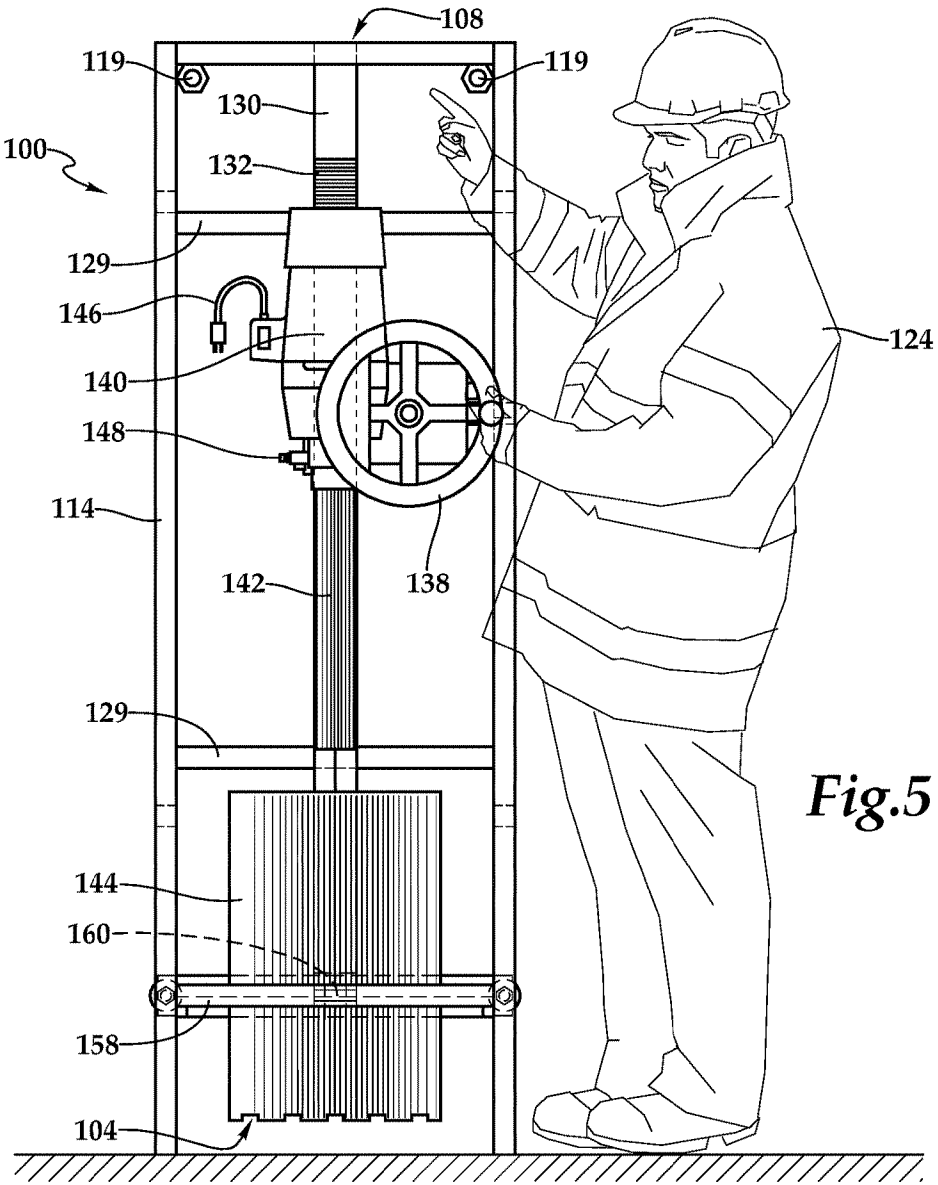
FIG. 5 illustrates the coring machine in a generally upright orientation.

As shown in FIGS. 1-4, frame assembly 102 may be positioned in a generally horizontal orientation, such that drilling device 104 may be used to, for example, core drill holes in a sidewall of a pipeline system. Further, frame assembly may be positioned in a generally upright orientation as shown in FIG. 5, such that drilling device 104 may be used to, for example, core drill an opening on a street for a manhole. It is further contemplated that coring machine 100 may be used at various angles. For instance, as shown in FIG. 2, coring machine 100 may include an inclinometer 164 such that an operator may determine the inclination angle and the depth of core bit 144. In particular, inclinometer 164 may be attached to frame assembly 102 for determining the slope gradient during coring operations using coring machine 100.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described in the application are to be taken as examples of embodiments. Elements and materials may be substituted for those illustrated and described in the application, parts and processes may be reversed, and certain features of the invention may be utilized independently, all as would be apparent to one skilled in the art after having the benefit of this description of the invention. Changes may be made in the elements described in the application without departing from the spirit and scope of the invention as described in the following claims.

What is claimed is:

1. A coring machine, comprising:

a frame assembly formed by a plurality of bars, said plurality of bars defining a front, a rear, a top, and a bottom of said frame assembly;

a track secured to said bottom of said frame assembly, said track extending longitudinally between the front and the rear of said frame assembly;

a mounting block configured to engage said track, said mounting block moveable along said track in response to rotation of a crank mechanically coupled to a gear assembly via a shaft; and a motor mounted on said mounting block, said motor operatively coupled to a core bit.

2. The coring machine of claim 1, wherein said frame assembly includes a rectangular cross section formed by said plurality of bars.

3. The coring machine of claim 1, further comprising a seat removably coupled to said top of said frame assembly.

4. The coring machine of claim 3, wherein the seat is removably coupled to said top of said frame assembly via a saddle.

5. The coring machine of claim 4, wherein said saddle is formed of a material bent back upon itself.

6. The coring machine of claim 3, wherein said shaft extends upwardly toward the top of said frame assembly from said gear assembly such that the crank is substantially level with said seat.

7. The coring machine of claim 1, wherein said track includes a plurality of teeth adapted to engage with a pinion of said gear assembly.

8. The coring machine of claim 1, wherein said motor is an electric motor including a connector configured to receive a water line.

9. The coring machine of claim 1, further comprising a guide configured to support the core bit.

10. The coring machine of claim 9, wherein each end of said guide is coupled to said frame assembly via a threaded rod extending from the bottom to the top of said frame assembly, said threaded rod including adjusting hardware for raising or lowering said guide.

11. The coring machine of claim 1, wherein said plurality of bars of the front of said frame assembly further includes bent bars extending from the bottom to the top of said frame assembly, said bent bars adapted to engaged a curved surface.

12. The coring machine of claim 1, wherein said plurality of bars of the top of said frame assembly further includes an eyelet defining an opening.

13. The coring machine of claim 1, wherein the rear of said frame assembly further includes corner holes configured to receive driving rods.

14. The coring machine of claim 1, wherein the bottom of said frame assembly further includes one or more removable wheels.

15. The coring machine of claim 1, further including an inclinometer coupled to said frame assembly.

16. The coring machine of claim 1, wherein said frame assembly is between about twelve inches and about twenty-four inches in height.

17. The coring machine of claim 1, wherein said frame assembly is between about forty-eight inches and about sixty inches in length.

18. The coring machine of claim 1, wherein said track is between about fifteen inches and about thirty inches in length.

* * * * *